US005764196A

United States Patent [19]

Fujimoto et al.

[11] Patent Number: 5,764,196

[45] Date of Patent: Jun. 9, 1998

[54] MULTIPLE LOOP ANTENNA

[75] Inventors: Masahiro Fujimoto; Shoshichi Saitoh; Katsuhisa Orihara; Susumu Yanagibori, all of Kanuma, Japan

[73] Assignee: Sony Chemicals Corp., Tokyo, Japan

[21] Appl. No.: 635,379

[22] Filed: Apr. 19, 1996

[30] Foreign Application Priority Data

Apr. 22, 1995 [JP] Japan ..... 7-120810

[51] Int. Cl.[6] ..... H01Q 21/00

[52] U.S. Cl. ..... 343/867; 343/742; 343/748; 343/868

[58] Field of Search ..... 343/867, 742, 343/866, 741, 743, 744, 745, 748, 868

[56] References Cited

U.S. PATENT DOCUMENTS 3,956,751 5/1976 Herman ..... 343/744
5,218,371 6/1993 Copeland et al. ..... 343/742

FOREIGN PATENT DOCUMENTS 0 594 375 A2 10/1993 European Pat. Off. .
3221 500 A1 12/1993 Germany .
4248704 5/1991 Japan .

*Primary Examiner*—Hoanganh T. Le
*Attorney, Agent, or Firm*—Hill & Simpson

[57] ABSTRACT

In a multiple loop antenna comprising a combination of a plurality of loop antennas, at least one factor among the diameter of each loop antenna, the number of turns thereof, the direction thereof, the effective permeability thereof, the relative values of electric currents of loop antennas and the phase difference of electric currents is controlled in such a way that the magnetic field intensity within the range extending from the multiple loop antenna to the distance of transmission wavelength of the multiple loop antenna decreases in inverse proportion to the n-th power (n>3) of the distance from the multiple loop antenna. This makes it possible to obtain a multiple loop antenna that has a high-intensity magnetic field within the predetermined communication zone but can steeply decrease the magnetic field intensity according to an increase in distance from the antenna and surely control the magnetic field intensity to be not greater than a stated value on the outside of the communication zone.

11 Claims, 5 Drawing Sheets

(wherein λ is from 100m to 1000m)

(wherein λ is from 100m to 1000m)

PRIOR ART

MULTIPLE LOOP ANTENNA

BACKGROUND OF THE INVENTION

1. Field of the Invention

This invention relates to a multiple loop antenna used in short-distance communication as in a building. More particularly, this invention relates to a multiple loop antenna that excites a high-intensity magnetic field within the predetermined communication zone, but can steeply decrease the magnetic field intensity according to an increase in distance from the loop antenna and control it to be not greater than a specified magnetic field intensity on the outside of the communication zone.

2. Description of the Related Art

Loop antennas are widely used as antennas used in medium wave, short wave or VHF band communication at short distance as in a building. For example, a micro-loop antenna 1 comprised of a single loop coil as shown in FIG. 7 is used as a communication antenna in non-contact IC card systems that receive and transfer information between an interrogator (a reader/writer) and a transponder (an IC card).

The magnetic field intensity attributable to such a micro-loop antenna decreases with an increase in distance from the loop antenna, successively in inverse proportion to the third power, second power and first power of the distance. Accordingly, in order to make the communication distance a bit longer to ensure a good communication quality, it is necessary to increase the radiation magnetic field intensity of the loop antenna.

However, increasing the radiation magnetic field intensity of the loop antenna may cause interference with neighboring equipment or neighboring communication systems. Hence, the radiated magnetic field intensity can not be made greater without limitation. In typical radio regulations, the magnetic field intensity at a stated distance from the loop antenna is limited to a level not greater than a stated level.

Thus, the short-distance communication systems making use of loop antennas have often caused the problem that the quality of communication can not be ensured because of the restriction on the radiation magnetic field intensity produced by the loop antennas.

To cope with such problems, one may contemplate to make up a multiple loop antenna by the use of a plurality of loop antennas and to control factors such as the number of turns of each loop antenna and electric currents so that a sufficient magnetic field intensity can be ensured within the service area of communication but the magnetic field intensity may turn almost zero at the points outside the communication zone that are positioned at a stated distance from the multiple loop antenna, controlling them while measuring the magnetic field intensity at that points.

If, however, the magnetic field intensity at the points positioned at a stated distance from the multiple loop antenna are merely controlled so as to turn zero, the magnetic field intensity is supposed to recover strong at the points further distant from that points. As a countermeasure therefor, one may contemplate that the points where the magnetic field intensity is controlled to turn to zero may be set at an infinitely long distance from the multiple loop antenna. However, it is impossible as a matter of fact to control the magnetic field intensity to be zero at such points while measuring the magnetic field intensity at the infinitely long distance.

SUMMARY OF THE INVENTION

The present invention will solve the problems involved in the prior art as discussed above. An object of the present invention is to provide a multiple loop antenna that has a high-intensity magnetic field within the predetermined communication zone but can steeply decrease the magnetic field intensity according to an increase in distance from the loop antenna and surely control the magnetic field intensity to be not greater than a specified value on the outside of the communication zone.

To achieve the above object, the present invention provides a method for producing a multiple loop antenna comprising a combination of a plurality of loop antennas, the method comprising controlling at least one factor among the diameter of each loop antenna, the number of turns thereof, the direction thereof, the effective permeability thereof, the relative values of electric currents of loop antennas and the phase difference of electric currents in such a way that the magnetic field intensity within the range extending from the multiple loop antenna to the distance of transmission wavelength($\lambda$) of the multiple loop antenna, preferably on condition of $1/k>>r$ (wherein $k=2\pi/\lambda$, r is radius of a loop antenna), decreases in inverse proportion to the n-th power ($n>3$) of the distance from the multiple loop antenna. The present invention also provides a multiple loop antenna the magnetic field intensity of which has been controlled in this way.

DETAILED DESCRIPTION OF THE INVENTION

According to the loop antenna of the present invention, at least one factor among the diameter of each loop antenna, the number of turns thereof, the direction thereof, the effective permeability thereof, the relative values of electric currents of loop antennas, and the phase difference of electric currents is controlled in such a way that the magnetic field intensity within the range extending from the multiple loop antenna to the distance of transmission wavelengths($\lambda$) of the multiple loop antenna, preferably on condition of $1/k>>r$ (wherein $k=2\pi/\lambda$, r is radius of a loop antenna), decreases in inverse proportion to the n-th power ($n>3$) of the distance from the multiple loop antenna.

By controlling the magnetic field intensity of the multiple loop antenna in this way, the magnetic field intensity can be decreased according to an increase in distance from the antenna, extending from the antenna to an infinitely long distance. Hence, the present invention makes it possible to decrease the magnetic field intensity outside the communication zone while ensuring a sufficiently high magnetic field intensity within the communication zone and to greatly prevent interference or obstruction to the neighboring equipments or neighboring communication systems.

Such control can be made not by measuring the magnetic field intensity at the infinitely long distance which is outside the communication zone, but practically by measuring magnetic field intensities at two points arbitrarily set within the range extending from the multiple loop antenna, preferably on condition of $1/k>>r$ (wherein $k=2\pi/\lambda$, r is radius of a loop antenna), and controlling parameters such as the diameter of each loop antenna, the number of turns thereof, the direction thereof, the effective permeability thereof, relative values of electric currents of loop antennas and the phase difference of electric currents in accordance with the degree of decrease of magnetic field intensity between the two points. The magnetic field intensity of the multiple loop antenna can be controlled with ease especially when a variable inductor, a variable capacitor or a variable resistor is connected to an antenna circuit of the loop antenna in addition to the individual loop antennas constituting the multiple loop antenna, or when a metal foil pattern or the like is provided around the loop antenna and the disposition or area of the metal foil is controlled.

The present invention will be specifically described below by giving preferred embodiments.

First Embodiment

Figure 1:
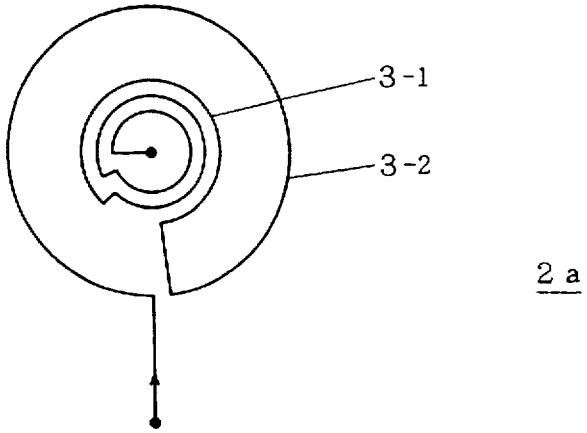
FIG. 1 is a diagrammatic view of a multiple loop antenna according to an embodiment of the present invention.

FIG. 1 diagrammatically illustrates a multiple loop antenna, 2a, according to an embodiment of the present invention. The multiple loop antenna shown in FIG. 1 has two loop antennas comprised of an inner loop antenna 3-1 and an external loop antenna 3-2 which are formed on the same plane by the use of a single conductor wire. In the present invention, the individual inner loop antenna 3-1 or external loop antenna 3-2 constituting the multiple loop antenna 2a is controlled in such a way that the magnetic field intensity of this multiple loop antenna 2a decreases to less than the level of inverse proportion to the third power of the distance from the multiple loop antenna 2a, within the range extending to the distance of transmission wavelength of the multiple loop antenna 2a. The matter will be described first in this regard.

Figure 5:
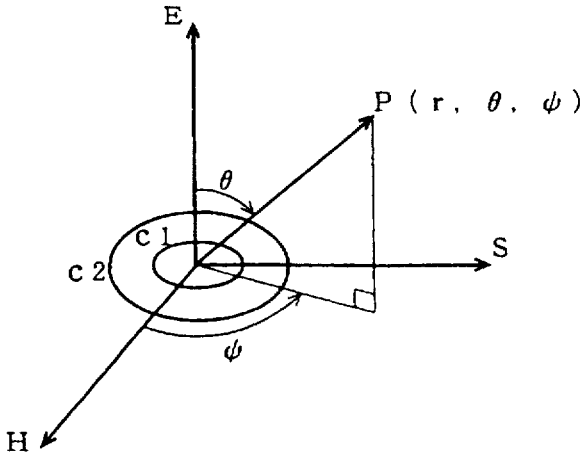
FIG. 5 is a model view used when a combined magnetic field intensity of two micro-loop antennas is considered.

In general, as shown in FIG. 5, when two micro-loop antennas c1 and c2 are put on a system of polar coordinates (r, θ, φ), a magnetic field intensity H at a point P (r, θ, φ) sufficiently distant from the individual loop antennas c1 and c2 (the point including an infinitely long distance) compared with the dimensions of C1 and C2 can be approximated by the following equations:

$$H_{ri}=\frac{n_iI_iS_i}{2\pi}\cdot e^{-jkr}\cdot\left(\frac{1}{r^3}+\frac{jk}{r^2}\right)\cos\theta$$

$$H_{\theta i}=\frac{n_iI_iS_i}{4\pi}\cdot e^{-jkr}\cdot\left(\frac{1}{r^3}+\frac{jk}{r^2}-\frac{k^2}{r}\right)\sin\theta$$

$$E_{\phi i}=-\frac{j\omega\mu I_iS_i}{4\pi}\cdot e^{-jkr}\cdot\left(\frac{1}{r^2}+\frac{jk}{r}\right)\sin\theta$$

wherein an affixed letter symbol i is 1 or 2, and corresponds to the individual loop antennas c1 and c2;

$I_i$: fed electric current flowing through the loop antenna;

$n_i$: the number of turns of the loop antenna;

$S_i$: the area surrounded by a closed curve constituting the loop antenna;

ω: angular frequency of signal;

$k=2\pi/\lambda$ (λ: wavelength); and

μ: permeability.

Therefore, the combined magnetic field at the point P is the sum of each loop antenna and is expressed as follows:

$$H_r=H_{r1}+H_{r2}$$

$$H_\theta=H_{\theta1}+H_{\theta2}$$

$$E_\phi=E_{\phi1}+E_{\phi2}$$

Here, when the individual loop antennas c1 and c2 are set so as to be $$n_1I_1S_1=-n_2I_2S_2,$$

it is seen that the combined magnetic field can be made almost zero at the point sufficiently distant from the loop antennas c1 and c2. However, it is impossible to control the magnetic field intensity to be zero at the points of infinitely long distance while measuring the magnetic field intensity at such points, in order to make the magnetic field intensity not exceeding a stated value in respect of the magnetic field extending up to the infinitely long distance outside the communication zone.

Now, in the present invention, the magnetic field intensity at the point within the range extending to the distance of transmission wavelength(λ) of the multiple loop antenna, i.e., the point P positioned at a distance shorter than the electromagnetic wavelength transmitted by the loop antennas c1 and c2 is considered, preferably on condition of $1/k>>r$ (wherein $k=2\pi/\lambda$, r is radius of a loop antenna). This magnetic field intensity at the point P can not be expressed in the same way as the magnetic field intensity at a point farther than that. However, when the loop antennas c1 and c2 are circular, the magnetic field component $H_{ri}$ at a distance r on their center axis is expressed as follows:

$$H_{ri}=\frac{n_iI_iS_i}{2\pi}\cdot\frac{1}{(r_i^2+r^2)^{3/2}}$$

wherein;

$r_i$: radius of a circular loop antenna; and $S_i$: area of a circular loop antenna ($S_i=\pi r_i^2$).

Therefore, the combined magnetic field $H_r$ can be expressed as follows:

$$H_r=\frac{1}{2\pi}\left\{\frac{n_1I_1S_1}{(r_1^2+r^2)^{3/2}}+\frac{n_2I_2S_2}{(r_2^2+r^2)^{3/2}}\right\}$$

Here, when the individual circular loop antennas are set so as to satisfy the condition of expression (1):

$$n_1I_1S_1=-n_2I_2S_2 \tag{1}$$

the combined magnetic field $H_r$ is expressed as follows:

$$H_r=\frac{n_1I_1S_1}{2\pi}\left\{\frac{1}{(r_1^2+r^2)^{3/2}}-\frac{1}{(r_2^2+r^2)^{3/2}}\right\}$$

From this expression, the combined magnetic field $H_r$ in this instance can be approximated as shown by the following equation (2) assuming $r>>r_1,r_2$:

$$H_r\simeq\frac{3n_1I_1S_1}{4\pi}\cdot\frac{r_2^2-r_1^2}{r^5} \tag{2}$$

As is seen from the foregoing, within the range of a distance shorter than the wavelength of electromagnetic waves transmitted by the loop antennas c1 and c2, the magnetic field intensity can be approximated to decrease in inverse proportion to the fifth power of the distance from the circular loop antennas when the individual loop antennas are set so as to satisfy the condition of equation (1).

In practice, however, the magnetic field intensity is affected by an error in the radii of the loop antennas, an error in the numbers of turns thereof, an error in electric currents and other various errors even if it is attempted to control the individual circular loop antennas so as to satisfy the condition of equation (1), and hence the magnetic field intensity does not decrease exactly in inverse proportion to the fifth power of the distance from the circular loop antennas, but decreases in inverse proportion to the n-th power (n>3), usually between the third and fifth power. Accordingly, in the present invention, the loop antennas are controlled so that the magnetic field intensity decreases in inverse proportion to the n-th power (n>3) of the distance from the circular loop antennas.

In the foregoing description, the individual loop antennas c1 and c2 are circular and are provided on the same plane as shown in FIG. 5. Also when the individual loop antennas c1 and c2 are not circular and are provided not on the same plane, the combined magnetic field intensity can be obtained according to the approximation equation (2) within the range of a distance shorter than the wavelength of electromagnetic waves transmitted by the loop antennas c1 and c2. Hence, the multiple loop antenna of the present invention is not limited to the case where a plurality of loop antennas constituting it are circular and are provided on the same plane.

As a specific method by which the individual loop antennas constituting the multiple loop antenna are controlled in such a way that its magnetic field intensity decreases in inverse proportion to the n-th power (n>3) of the distance from the multiple loop antenna, it is exemplified by the following: In the case of the multiple loop antenna 2a as shown in FIG. 1, magnetic field intensities at two points arbitrarily chosen within the range extending from the multiple loop antenna to the distance of transmission wavelength (λ) of the multiple loop antenna, preferably on condition of $1/k \gg r$ (wherein $k=2\pi/\lambda$, r is radius of a loop antenna) are measured, and parameters of the inside loop antenna 3-1 or outside loop antenna 3-2 may be appropriately controlled so that the state of decrease of magnetic field intensity between the two points is in inverse proportion to the fifth power of the distance from the multiple loop antenna 2a (i.e., the condition of expression (1):

$$n_1 I_1 S_1 = -n_2 I_2 S_2 \quad (1)$$

is satisfied). In this instance, the parameters of the antenna may include the diameter of each loop antenna, the number of turns thereof, the direction thereof, the effective permeability thereof, the relative values of an electric currents of loop antennas and the phase difference of electric currents. However, it is difficult as a matter of fact to control the diameter of each antenna finely, and hence, usually, the number of turns and electric currents may be adjusted.

Figure 6:
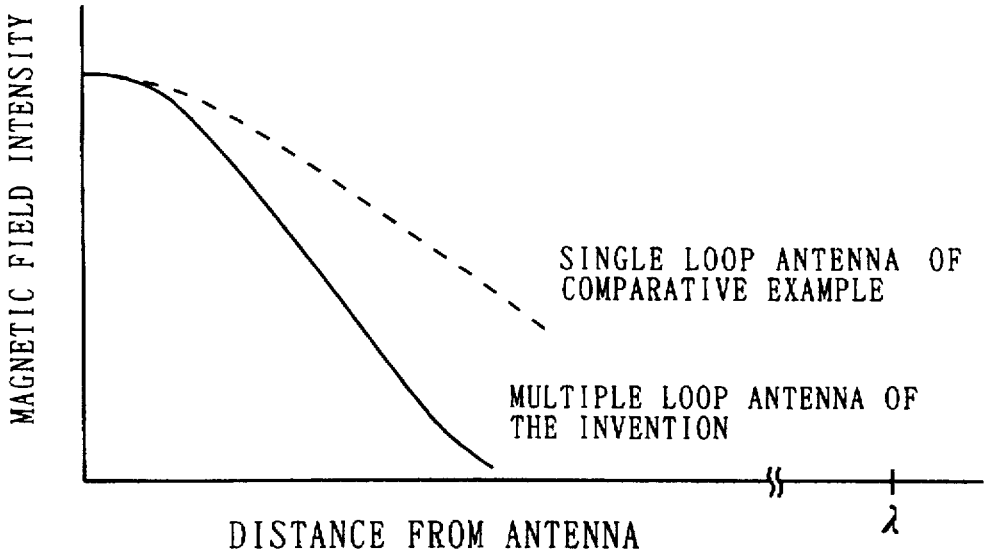
FIG. 6 shows the relationship between the distance from the loop antenna and the magnetic field intensity.
Figure 7:
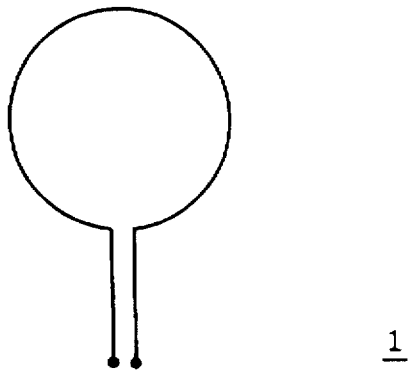
FIG. 7 is a diagrammatic view of a conventional, single micro-loop antenna.

In respect of the multiple loop antenna thus adjusted, the relationship between the distance from the multiple loop antenna and the magnetic field intensity thereof is shown in FIG. 6. As shown therein by a solid line, the magnetic field intensity decreases in inverse proportion to the fifth power of the distance, and hence the antenna could have a high magnetic field intensity within the communication zone, but the magnetic field intensity steeply decreases with an increase in distance, and the magnetic field intensity further decreases to turn almost zero on the outside of the communication zone. Thus, it is possible to prevent interference or obstruction to the neighboring equipments or neighboring communication systems while ensuring a high magnetic field intensity within the predetermined communication zone. For comparison, in respect of a single loop antenna having a magnetic field intensity equal to that in the above embodiment, the relationship between the distance from the loop antenna and the magnetic field intensity thereof is shown together in FIG. 6. As shown therein, the single loop antenna exhibits less decrease of its magnetic field intensity in accordance with the distance from the antenna, and hence the magnetic field intensity on the outside of the communication zone can not be well decreased if it is attempted to ensure a high magnetic field intensity within the predetermined communication zone, so that the neighboring equipments or neighboring communication systems are adversely affected.

Second Embodiment

Figure 2A:
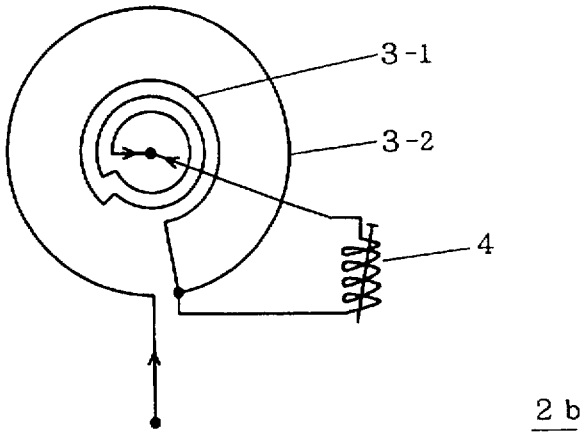
FIGS. 2A–2C are illustrations of multiple loop antennas according to another embodiment of the present invention.

FIG. 2 diagrammatically illustrates a preferred embodiment of the present invention. This multiple loop antenna, 2b, is comprised of an inside loop antenna 3-1 and an outside loop antenna 3-2 to the both of which a variable inductor 4 with ferrite core is connected as a magnetic field intensity fine-adjusting means.

Figure 2B:
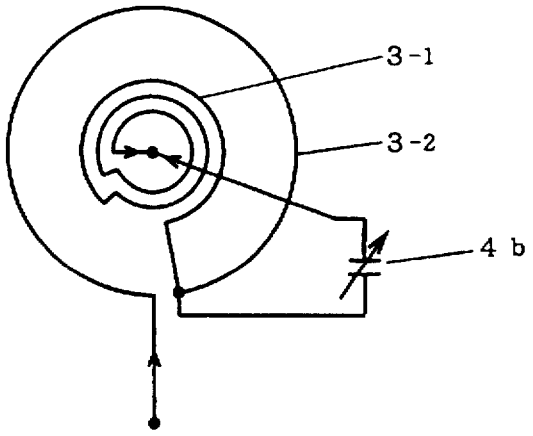
Figure 2C:
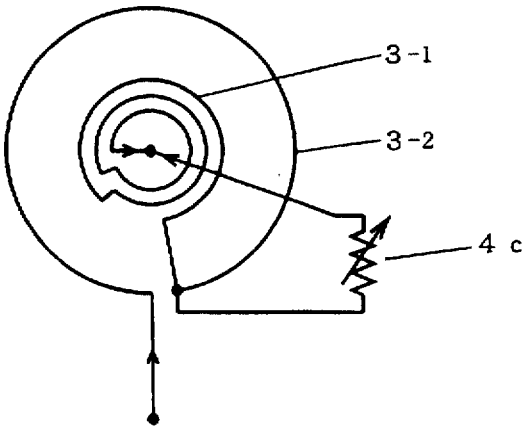

FIGS. 2B–2C are alternate embodiments employing a variable capacitor and a variable resistor respectively.

In general, when the loop antenna is formed by winding a single conductor wire, it is difficult to wind it at a preset position in a good precision, as being different from the case when the conductor wire is wound around a fixed member such as a core. Hence, it is also difficult to control the magnetic field intensity so as to decrease in inverse proportion to the fifth power of the distance from the loop antenna. More specifically, in the above equation (2), if the loop antenna c2 has an error α with respect to the intended radius $r_2$, the equation (2) is represented by the following equation:

$$H'_r \simeq \frac{3n_1 I_1 S_1}{4\pi} \cdot \frac{(r_2+\alpha)^2 - r_1^2}{r^5}$$

and further can be approximated as shown below.

$$H'_r \simeq H_r + \frac{3n_1 I_1 S_1}{4\pi} \cdot \frac{2r_2\alpha + \alpha^2}{r^5}$$

Thus, as is seen from the foregoing, the magnetic field intensity is affected to the extent of the first power and the second power of the error α. The deviation of magnetic field intensity that is caused by such deviation of precision in the winding of the loop antenna can be compensated with ease when the variable inductor with ferrite core connected to the multiple loop antenna. It also becomes easy to make control so as to satisfy the condition of:

$$n_1 I_1 S_1 = -n_2 I_2 S_2 \quad (1)$$

for decreasing the magnetic field intensity in inverse proportion to the fifth power of the distance from the loop antenna.

Third Embodiment

Figure 3A:
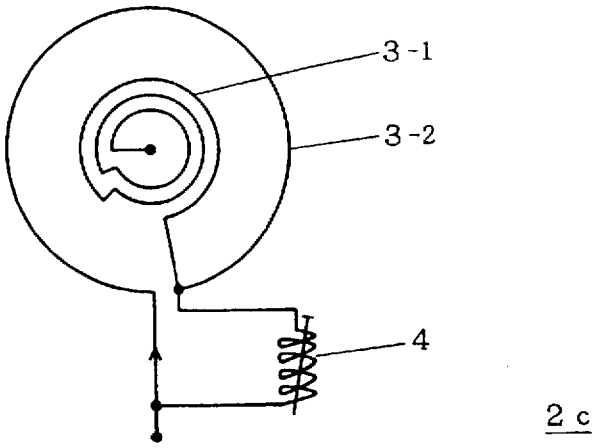
FIGS. 3A–3C are illustrations of multiple loop antennas according to still another embodiment of the present invention.

FIG. 3 also diagrammatically illustrates a preferred embodiment of the present invention. In this multiple loop antenna, 2c, a variable inductor 4 with a ferrite core is also connected like the second embodiment as a magnetic field intensity fine-adjusting means, provided that the variable inductor 4 with the ferrite core is connected at positions different from those in the second embodiment.

Figure 3B:
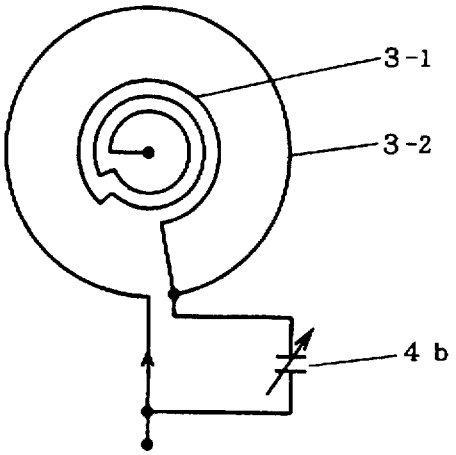
Figure 3C:
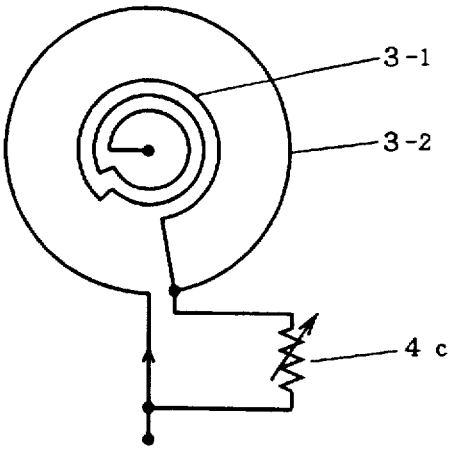

FIGS. 3B–3C illustrate alternate embodiments which employ a variable capacitor and a variable resistor respectively.

Fourth Embodiment

Figure 4:
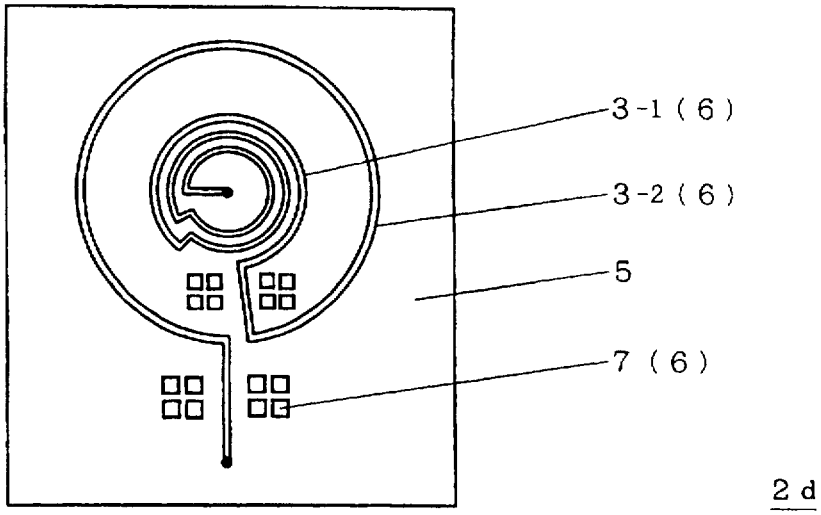
FIG. 4 is a diagrammatic view of a multiple loop antenna according to a further embodiment of the present invention.

FIG. 4 still also diagrammatically illustrates a preferred embodiment of the present invention. In this multiple loop antenna, 2*d*, the inner loop antenna 3-1 and the external loop antenna 3-2 are formed by etching a copper layer 6 on a substrate 5. Also, to provide the fine-adjusting means of the magnetic field intensity, a fine-adjusting pattern 7 is formed by similarly etching the copper foil 6 on the substrate 5.

It is preferable to form the individual loop antennas 3-1 and 3-2 by the etching of metal foil on the substrate, since they can be formed in a better precision than the case when formed by winding a single conductor wire. It is also advantageous in that the individual loop antennas and the fine adjusting pattern of the magnetic field intensity can be formed at the same time.

When the fine-adjusting pattern 7 of the magnetic field intensity is used to control the magnetic field intensity so as to decrease in inverse proportion to the fifth power of the distance from this multiple loop antenna 2*c*, the control can be made with ease by appropriately stripping or adding the fine-adjusting pattern of the magnetic field intensity.

As described above in detail by giving specific embodiments, the present invention makes it possible to obtain a multiple loop antenna that has a high-intensity magnetic field within the predetermined communication zone but can steeply decrease the magnetic field intensity with an increase in distance from the antenna and surely control the magnetic field intensity to be not greater than a stated value on the outside of the communication zone.

We claim:

1. A multiple loop antenna comprising: a plurality of loop antennas, wherein at least one factor among a diameter of each loop antenna, a number of turns, a transmission direction, an effective permeability, relative values of electric currents of the loop antennas and a phase difference of electric currents has been adjusted in such a way that a magnetic field intensity within a range extending from the plurality of multiple loop antennas to a distance of transmission wavelength of the plurality of multiple loop antennas decreases in inverse proportion to the n-th power of the distance from the multiple loop antenna where n>3.

2. The multiple loop antenna according to claim 1, wherein n is about 5.

3. The multiple loop antenna according to claim 1 or 2, wherein a fine-adjusting means for fine-adjusting the magnetic field intensity of the multiple loop antenna is provided in such a way that the magnetic field intensity within the range extending from the multiple loop antenna to the distance of transmission wavelength of the multiple loop antenna decreases in inverse proportion to the n-th power of the distance from the multiple loop antenna where n>3.

4. The multiple loop antenna according to claim 3, wherein said magnetic field intensity fine-adjusting means comprises a variable inductor, a variable capacitor or a variable resistor connected to an antenna circuit, or a metal foil provided around a loop antenna.

5. The multiple loop antenna according to any one of claims 1 to 4, wherein said loop antennas are substantially circular, and are provided on the same plane.

6. A method for producing a multiple loop antenna comprising a plurality of loop antennas, the method comprising controlling at least one factor among a diameter of each loop antenna, a number of turns, a transmission direction, an effective permeability, relative values of electric currents of the loop antennas and a phase difference of electric currents in such a way that a magnetic field intensity within a range extending from the multiple loop antenna to a distance of transmission wavelength of the multiple loop antenna decreases in inverse proportion to the n-th power of the distance from the multiple loop antenna where n>3.

7. The method for producing a multiple loop antenna according to claim 6, wherein n is about 5.

8. The method for producing a multiple lop antenna according to claim 6 or 7, wherein a fine-adjusting means for fine-adjusting the magnetic field intensity of the multiple loop antenna is provided, and the magnetic field intensity within the range extending from the multiple loop antenna to the distance of transmission wavelength of the multiple loop antenna is adjusted by the fine-adjusting means of the magnetic field intensity so as to decrease in inverse proportion to the n-th power of the distance from the multiple loop antenna where n>3.

9. The method for producing a multiple loop antenna according to claim 8, wherein a variable inductor, a variable capacitor or a variable resistor connected to an antenna circuit or a metal foil provided around a loop antenna is provided as said fine adjusting means of the magnetic field intensity.

10. The method for producing a multiple loop antenna according to any one of claims 6 to 9, wherein said loop antennas are substantially circular, and are provided on the same plane.

11. A method of transmitting information comprising the steps of:

providing a multiple loop antenna;

controlling a magnetic field intensity generated by the multiple loop antenna such that the magnetic field intensity decreases in inverse proportion to an nth power of a distance from the multiple loop antenna, within a distance range from the multiple loop antenna to a distance of transmission wavelength of the multiple loop antenna where n>3.

* * * * *